US005250232A

United States Patent [19]

Pepper et al.

[11] Patent Number: 5,250,232

[45] Date of Patent: Oct. 5, 1993

[54] HUMIDIFIER

[75] Inventors: Kenneth V. Pepper, Plymouth; John W. Seaman, Sheboygan Falls, both of Wis.

[73] Assignee: Bemis Manufacturing Company, Sheboygan Falls, Wis.

[21] Appl. No.: 916,356

[22] Filed: Jul. 17, 1992

Related U.S. Application Data

[63] Continuation-in-part of Ser. No. 825,298, Jan. 23, 1992, Pat. No. 5,133,904, which is a continuation of Ser. No. 599,008, Oct. 17, 1990, abandoned.

[51] Int. Cl.[5] ..... B01F 3/04

[52] U.S. Cl. ..... 261/24; 261/107

[58] Field of Search ..... 261/107, 99, 24

[56] References Cited

U.S. PATENT DOCUMENTS

| | | | |
|---|---|---|---|
| 765,351 | 7/1904 | Avery et al. . | |
| 794,938 | 7/1905 | Houlon . | |
| 796,557 | 8/1905 | Bockoven . | |
| 1,058,808 | 4/1913 | Thilges . | |
| 1,272,275 | 7/1918 | Klein . | |
| 1,367,701 | 2/1921 | Haynes . | |
| 1,451,329 | 5/1922 | Dressler . | |
| 1,606,472 | 2/1924 | Kieffer et al. . | |
| 1,625,663 | 6/1926 | Kelly . | |
| 1,646,329 | 10/1927 | Ulrich | 261/107 |
| 1,817,357 | 4/1928 | Fisher . | |
| 1,887,242 | 3/1929 | Martinson . | |
| 1,916,907 | 7/1933 | Sargent . | |
| 2,054,200 | 3/1933 | Langford | 219/39 |
| 2,104,209 | 1/1938 | Pierson | 261/107 |
| 2,307,938 | 5/1941 | Mathias | 261/99 |
| 2,474,746 | 5/1948 | Lopez et al. | 261/99 |
| 2,562,589 | 7/1951 | Uttz | 261/99 |
| 2,566,366 | 7/1948 | Pennington | 62/139 |
| 2,614,820 | 10/1952 | Boydjieff | 261/99 |
| 2,669,319 | 11/1951 | Inglesby | 183/17 |
| 2,730,340 | 2/1953 | Patriarca | 261/26 |
| 2,749,725 | 6/1956 | Essman et al. | 62/131 |
| 2,800,306 | 7/1957 | Freeman | 257/3 |
| 2,906,512 | 9/1959 | Meek | 261/24 |
| 3,152,723 | 12/1961 | Perl et al. | 222/23 |
| 3,341,073 | 9/1967 | Arps et al. | 222/36 |
| 3,400,919 | 9/1968 | Schall | 261/102 |
| 3,409,219 | 11/1968 | Behnke | 237/78 |
| 3,465,915 | 9/1969 | DeHarde | 222/66 |
| 3,598,370 | 8/1971 | Hoag | 261/26 |
| 3,619,988 | 11/1971 | Cornell, III | 55/234 |
| 3,621,834 | 11/1971 | Keuls | 55/234 |
| 3,637,194 | 1/1972 | Swimmer et al. | 261/29 |
| 3,757,494 | 9/1973 | Keuls | 55/234 |
| 3,811,661 | 5/1974 | Procter | 261/26 |
| 3,885,843 | 5/1975 | Rubel | 312/31 |
| 4,031,171 | 6/1977 | Asao et al. | 261/1 |
| 4,087,495 | 5/1978 | Umehara | 261/81 |
| 4,135,370 | 1/1979 | Hosoda et al. | 62/274 |
| 4,186,848 | 2/1980 | Walter | 222/23 |
| 4,216,176 | 8/1980 | Tanaka | 261/42 |
| 4,257,989 | 3/1981 | Nishikawa | 261/4 |
| 4,338,576 | 7/1982 | Takashashi et al. | 331/67 |
| 4,500,479 | 2/1985 | Fukami et al. | 261/99 |
| 4,698,188 | 10/1987 | Gutmann | 261/107 |
| 4,712,713 | 12/1987 | Karlis et al. | 222/3 |
| 4,921,639 | 5/1990 | Chiu | 261/67 |
| 5,108,663 | 4/1992 | Chiu | 261/26 |
| 5,133,904 | 7/1992 | Pepper | 261/24 |
| 5,143,655 | 9/1992 | Chiu et al. | 261/107 |

FOREIGN PATENT DOCUMENTS

| | | | |
|---|---|---|---|
| 2604169 | 8/1977 | Fed. Rep. of Germany | 261/107 |
| 3507544 | 9/1986 | Fed. Rep. of Germany | 261/99 |
| 759262 | 11/1933 | France | 261/99 |
| 197808 | 8/1978 | Switzerland | 261/107 |
| 631134 | 7/1982 | Switzerland | 222/23 |
| 892319 | 3/1962 | United Kingdom | 261/99 |

*Primary Examiner*—Tim Miles

*Attorney, Agent, or Firm*—Michael, Best & Friedrich

[57] ABSTRACT

A portable humidifier adapted to rest on a supporting surface, the humidifier comprising a base defining a water reservoir and including a bottom wall having therein an air inlet opening spaced horizontally from the reservoir, legs supporting the bottom wall above the supporting surface, a wicking element having a lower portion in fluid communication with the water reservoir, extending transversely relative to vertical, and extending above the inlet opening, and a fan for forcing air flow through the inlet opening and through the wicking element.

18 Claims, 5 Drawing Sheets

HUMIDIFIER

RELATED APPLICATION

This is a continuation-in-part of Ser. No. 825,298, filed Jan. 23, 1992, now U.S. Pat. No. 5,133,904, which is a continuation of Ser. No. 599,008, filed Oct. 17, 1990, now abandoned.

BACKGROUND OF THE INVENTION

1. Field of the Invention

This invention relates to humidifiers, and more particularly to evaporative home humidifiers.

2. Description of the Prior Art

A conventional home humidifier includes a reservoir or tank of water through which is passed an endless belt fabricated of an air permeable medium such as reticulated polyurethane foam. Air blown through the portion of the belt that is not in the water evaporates water from the belt and transfers the water to the atmosphere as a vapor.

Another known humidifier includes a reservoir or tank of water and a wicking element that is supported in the water on floats so that only the lower end of the wicking element is immersed in the water. The wicking element moves downwardly relative to the reservoir as the water level falls. Air blown through the wicking element evaporates water from the wicking element and transfers water to the atmosphere.

Another known humidifier includes a water reservoir and a stationary wicking element having its lower end in the water reservoir.

SUMMARY OF THE INVENTION

The invention provides a humidifier utilizing a stationary wicking element. The wicking element has a honeycomb or other suitable form and sits with only its bottom edge immersed in a trough of water. Wicking action causes the water to saturate the wicking element, and air is passed through the wicking element in order to transfer water vapor to the atmosphere.

It is believed that capillary attraction is the primary force that causes the water to be drawn up to saturate the wicking element. Accordingly, the present invention places the wicking element into the trough of water at an angle to reduce the effect of gravity which opposes the transfer of water up the wicking element by capillary attraction. Placing the wicking element into the trough of water at an angle allows the wicking element to become wetter at its uppermost point than conventional wicking elements which are placed vertically into the trough of water. This more uniform wetting of the wicking element provides an increased water evaporation rate as compared to conventional vertical wicking elements. It has been discovered that by angling a wicking element which was previously vertical and extending ten inches above the water to a height of eight inches above the water will increase the water evaporation rate by approximately twenty percent.

The humidifier further comprises a fan or blower for transferring water from the wicking element to the atmosphere. This fan or blower pulls air through the wicking element and increases the evaporation of water from the wicking element.

In one embodiment of the invention, the humidifier is a portable or "tabletop" humidifier. The humidifier includes a base defining the water trough, and the base is supported above a table or other supporting surface by legs. The bottom wall of the base has therein air inlet openings, and the wicking element is tilted so that the wicking element extends over the air inlet openings. This arrangement provides maximum air flow through the wicking element.

Other features and advantages of the invention will become apparent to those skilled in the art upon review of the following detailed description, claims and drawings.

DESCRIPTION OF THE DRAWINGS

FIG. 12 is a bottom view of the humidifier shown in FIG. 7.

Figure 1:
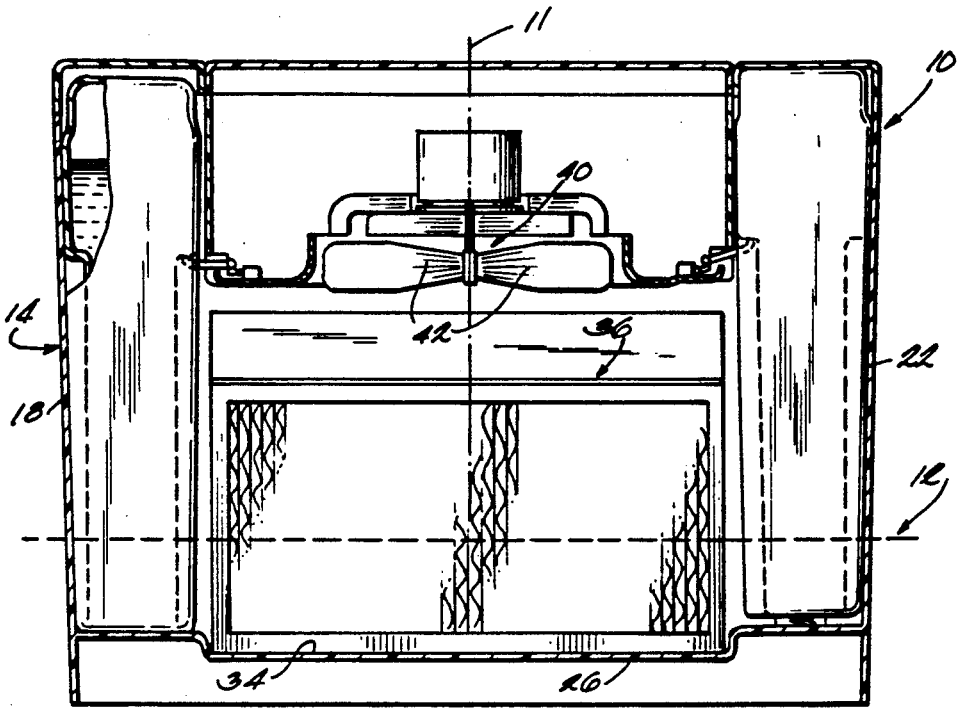
FIG. 1 is a rear elevational view, partially in section, of a humidifier embodying the invention.

Before one embodiment of the invention is to be explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A humidifier 10 embodying the invention is illustrated in FIGS. 1–4. Except as described below, the humidifier 10 is substantially identical to the humidifier described in U.S. Ser. No. 512,889, filed Apr. 23, 1990 and now abandoned, which is assigned to the assignee hereof, and which is herein incorporated by reference. The humidifier 10 has a vertical axis 11 and is intersected by a horizontal plane 12. The humidifier 10 comprises a cabinet 14 having opposite right and left side walls 18 and 22 and a bottom wall 26 and a rear wall 30 extending between the side walls 18 and 22. The rear wall 30 has therein (see FIG. 3) an air inlet 32. A filter 33 is mounted on the rear wall 30 over the inlet 32. The bottom wall 26 defines a trough or water reservoir 34 located adjacent to the air inlet 32 and adapted to contain water. The trough 34 is elongated in the direction extending between the side walls 18 and 22.

Figure 3:
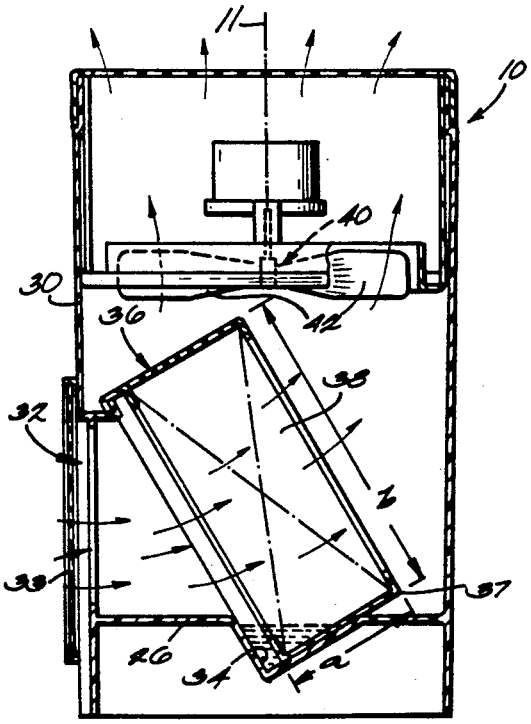
FIG. 3 is a vertical sectional view of the humidifier.
Figure 2:
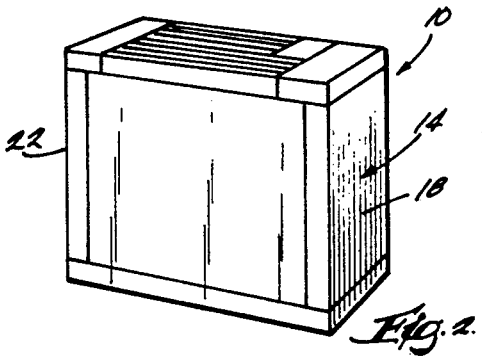
FIG. 2 is a front perspective view of the humidifier.
Figure 4:
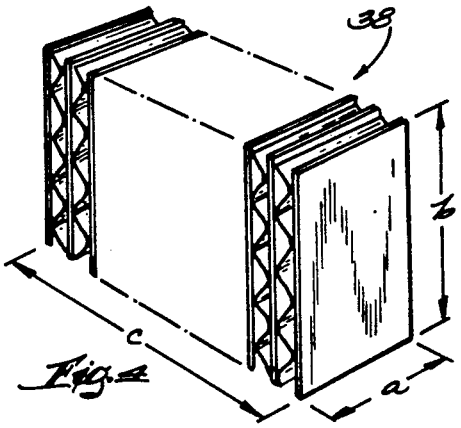
FIG. 4 is a partial perspective view of a wicking element.

The humidifier 10 also comprises a wicking assembly 36 including a frame 37 supporting a wicking element 38. The wicking element 38 extends transversely relative to the vertical axis 11 and has a lower portion in fluid communication with the water reservoir 34. Preferably, as shown in FIG. 3, the wicking element 38 has its lower portion in the water reservoir 34. The wicking element 38 can have any suitable construction and can be formed of any suitable material. However, the wicking element 38 is preferably constructed in a "honeycomb" form and is preferably formed of a high density nonwoven cellulosic material. The wicking element 38 has (see FIGS. 3 and 4) a minor dimension "a" extending transversely to the horizontal plane 12, a first major dimension "b" which is greater than the minor dimension "a" and which extends perpendicularly to the minor dimension "a", and a second major dimension "c" which is greater than the minor dimension "a" and which extends perpendicularly to the first major dimension "b" and to the minor dimension "a". Preferably, the minor dimension "a" extends at an angle of approximately 30 degrees relative to the plane 12, and the major dimension "b" extends at an angle of approximately 30 degrees relative to the vertical axis 11.

The humidifier 10 also comprises means for transferring water from the wicking element 38 to the atmosphere. This means preferably includes fan means for forcing air flow in a non-horizontal direction, i.e. in the direction of the minor dimension "a", through the wicking element 38. Although any suitable fan means can be employed, the fan means preferably includes an electric fan 40 having a plurality of fan blades 42 supported within the cabinet 14. The fan 40 draws air through the wicking element 38. The air then passes out of the humidifier 10 and transfers water vapor to the atmosphere.

It is believed that capillary attraction is the primary force that causes water to be drawn up from the water reservoir 34 to saturate the wicking element 38. Thus, gravity is a counterforce that resists the vertical transfer of water by capillary attraction. The advantage of using an angled or horizontal wicking element rather than a vertical wicking element is that the angled or horizontal wicking element becomes more uniformly saturated with water throughout its entire height than the vertical wicking element. This more uniform saturation of the wicking element provides an increase in the evaporation rate of the water as compared to humidifiers utilizing a vertical wicking element.

In humidifiers utilizing vertical wicking elements, the area of the wicking element immediately above the water level in the water reservoir and for approximately two to three inches above this level is truly saturated. However, at the level ten inches above the water level, the wicking element is merely moist. Experimental work has shown that approximately ten inches above the water level is the greatest height that capillary attraction can elevate water from the water reservoir. Thus, it appears that at ten inches above the water level, the force of gravity exceeds the capillary attraction of the wicking element and there is thereafter only negligible water transfer.

By placing the wicking element at an angle or horizontally, a wicking element of the same or greater "height" as a vertical element can be used while at the same time lowering the uppermost part of the wicking element in relation to the surface of the water in the water reservoir. This will allow the wicking element to become wetter at its uppermost part. If the wicking element is placed into the water reservoir such that its uppermost part is less than four inches above the water level in the water reservoir, the entire wicking element will be saturated with water.

Figure 5:
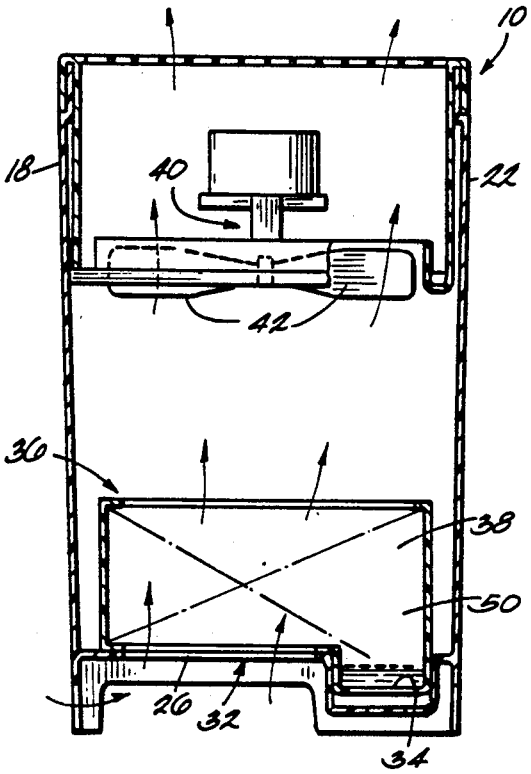
FIG. 5 is a sectional view of an alternative embodiment of the invention.

An alternative embodiment of the invention is shown in FIG. 5. In this alternative embodiment, the wicking element 38 extends generally perpendicularly to the vertical axis 11. In other words, the major dimensions of the wicking element 38 extend perpendicularly to the axis 11. The wicking element 38 is L-shaped and has a lower portion located in the reservoir 34. The air inlet 32 is located in the bottom wall 26. The fan 40 forces vertical air flow through the wicking element 38.

Figure 6:
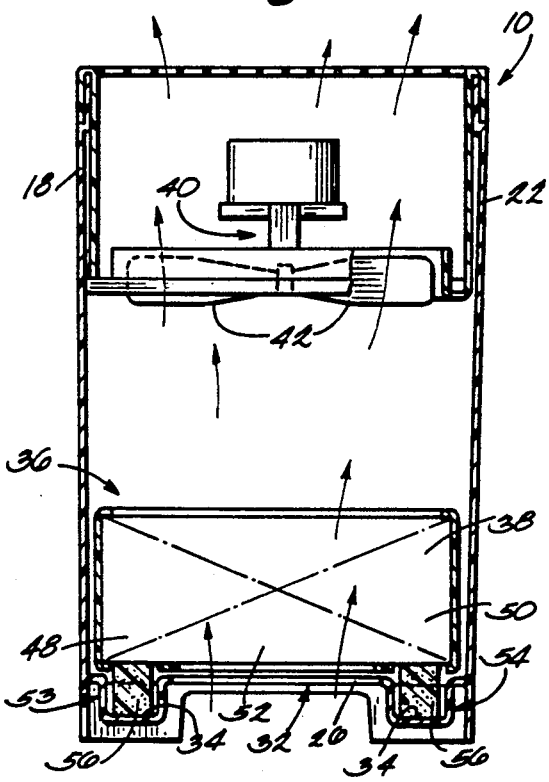
FIG. 6 is a sectional view of a second alternative embodiment of the invention.

A second alternative embodiment is shown in FIG. 6. In this embodiment, the wicking element 38 extends generally perpendicularly to the vertical axis 11. The wicking element 38 includes generally horizontally spaced-apart peripheral portions 48 and 50, and a central portion 52 located between the peripheral portions 48 and 50. The reservoir 34 includes spaced apart portions 53 and 54, and the peripheral portions 48 and 50 are seated on respective means, such as a wettable sponge-like material 56, located in the portions 53 and 54 of the water reservoir 34 for transferring water from the water reservoir 34 to the peripheral portions 48 and 50 of the wicking element 38. The air inlet 32 is located in the bottom wall 26 beneath the central portion 52 of the wicking element 38. The fan means forces substantially vertical air flow through the central portion of the wicking element 38.

A humidifier that is a third alternative embodiment of the invention is shown in FIGS. 7–12. The humidifier 100 comprises a base 104 that is generally elliptical in horizontal cross-section. The base 104 includes an endless side wall 108 and a bottom wall 112. The bottom wall 112 is supported above a supporting surface 116 by a plurality of legs 120. The base 104 has a longitudinal axis 124, and the bottom wall 112 defines a T-shaped water trough or reservoir 128 including a first leg 132 extending along the axis 124 and a second leg 136 extending perpendicular to the axis 124. The bottom wall 112 includes a portion 140 which is tilted at an angle of approximately 20 degree with respect to horizontal and which defines the bottom of the second leg 136. The bottom wall 112 has therein generally kidney-shaped inlet openings 144 and 148 spaced horizontally from the reservoir 128 and located on opposite sides of the first leg 132 and adjacent the second leg 136. This arrangement of the trough 128 and the inlet openings 144 and 148 allows the overall humidifier to be relatively compact.

The side wall 108 of the base 104 has therein, adjacent the opposite ends of the base, finger recesses 152 that facilitate handling of the humidifier 100. The recesses 152 are defined in part by respective vertically extending walls 154 which are partially cut away to provide air inlet openings 158. The air inlet openings 158 facilitate air flow from the exterior of the base 104 to the air inlet openings 144 and 148 in the bottom wall 112. Such air flow is indicated by the broken arrows in FIG. 8.

Figure 8:
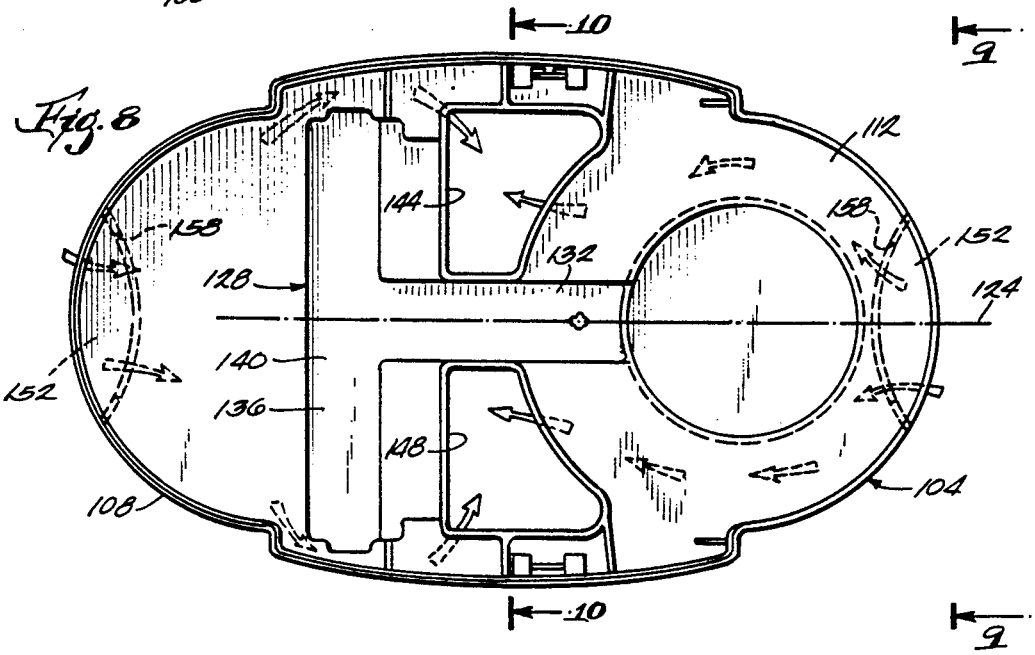
FIG. 8 is a top plan view of the base of the humidifier shown in FIG. 7.
Figure 9:
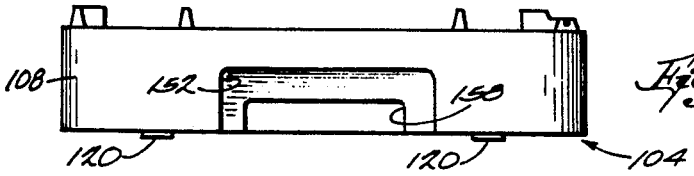
FIG. 9 is a view taken along line 9—9 in FIG. 8.
Figure 10:
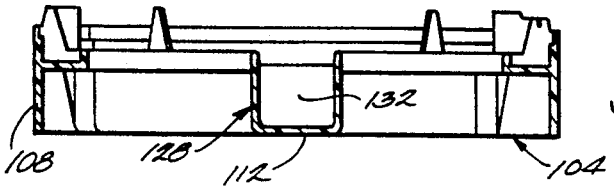
FIG. 10 is a view taken along line 10—10 in FIG. 8.
Figure 11:
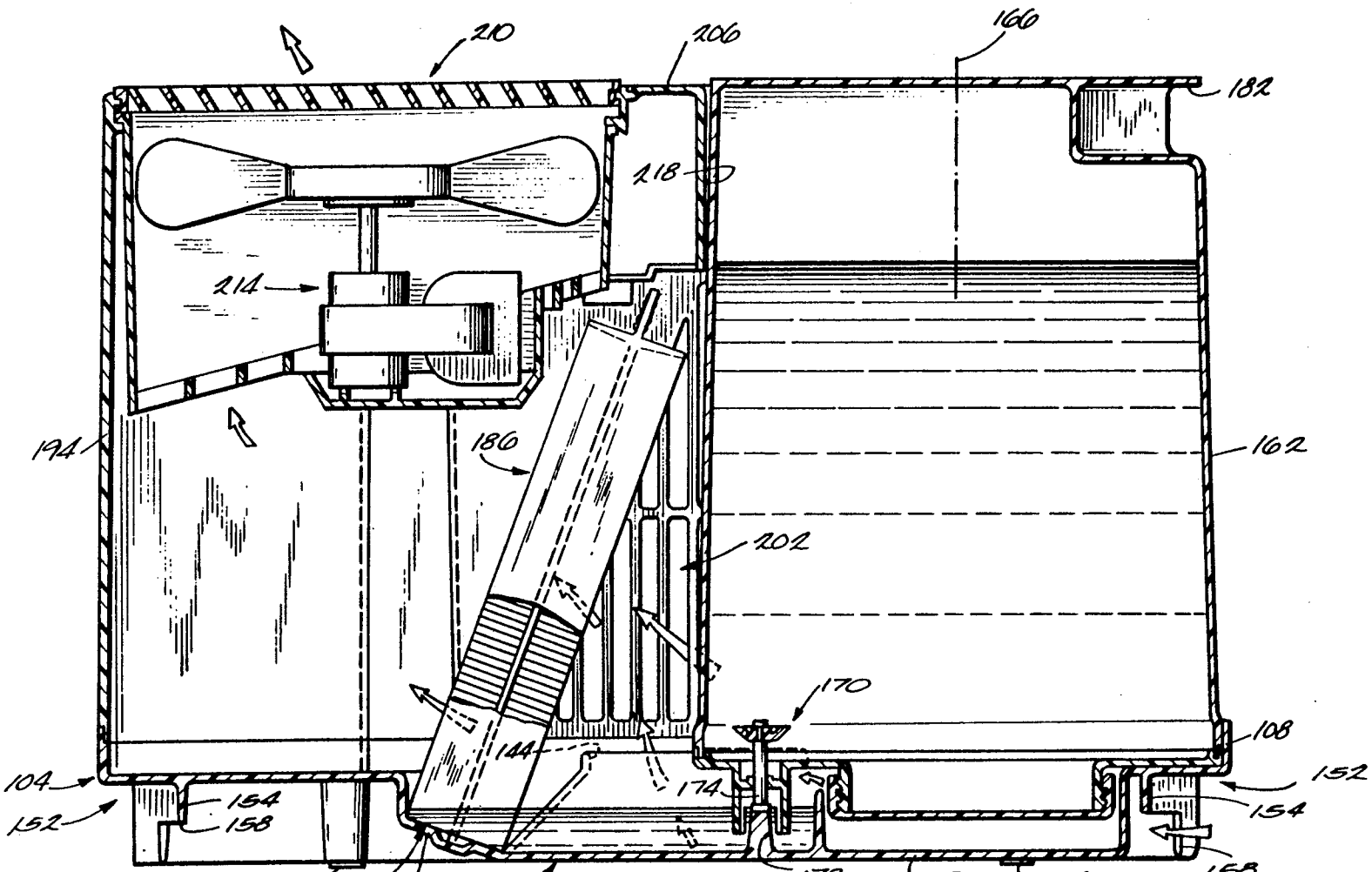
FIG. 11 is a vertical sectional view of the humidifier shown in FIG. 7.
Figure 11:
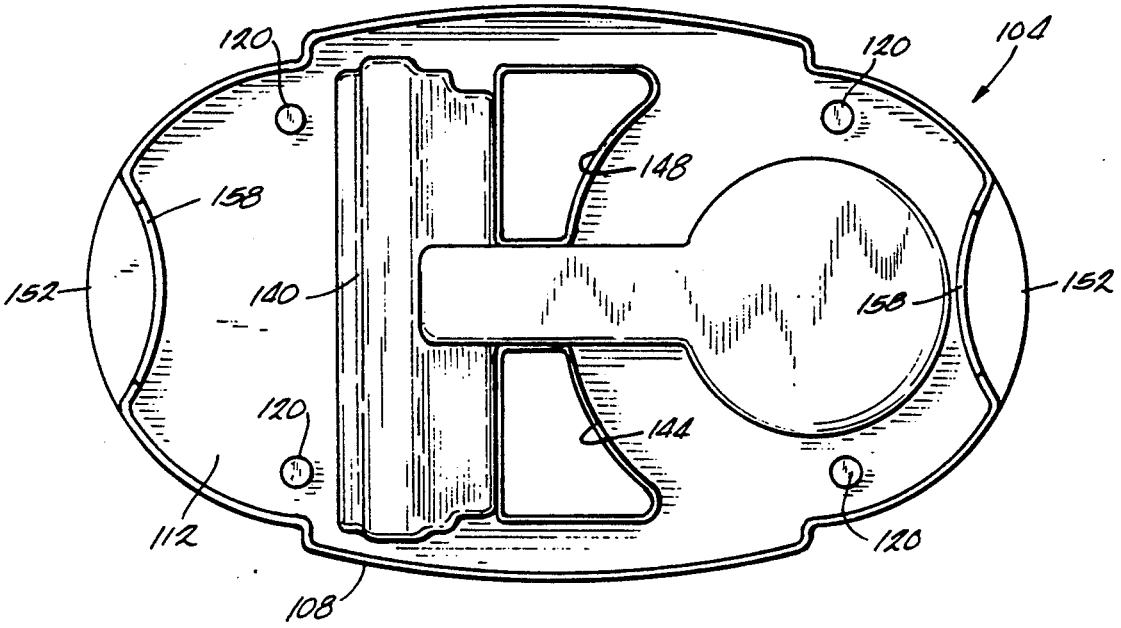

The humidifier 100 also comprises a generally cylindrical water bottle 162 that sits on the right end (as shown in FIGS. 8 and 11) of the base 104. The water bottle 162 has a generally vertical longitudinal axis 166. The lower end of the water bottle 162 includes a conventional valve 170 having a plunger 174 that is moved upwardly by a projection 178 on the base when the water bottle 162 is seated on the base 104. Upward movement of the plunger 174 opens the valve 170 and allows water to flow out of the bottle 162 and fill the trough 128. The upper end of the water bottle 162 has therein finger recesses 182 that facilitate handling of the water bottle 162.

The humidifier 100 further comprises a wicking element 186 seated in the second leg 136 of the trough 128. As shown in FIG. 11, the wicking element 186 includes a bottom wall 190 seated against the wall portion 140 of the base 104, so that the wicking element 186 extends at an angle of approximately 20 degrees with respect to vertical. As shown in FIG. 11, the wicking element extends above the inlet openings 144 and 148.

Figure 7:
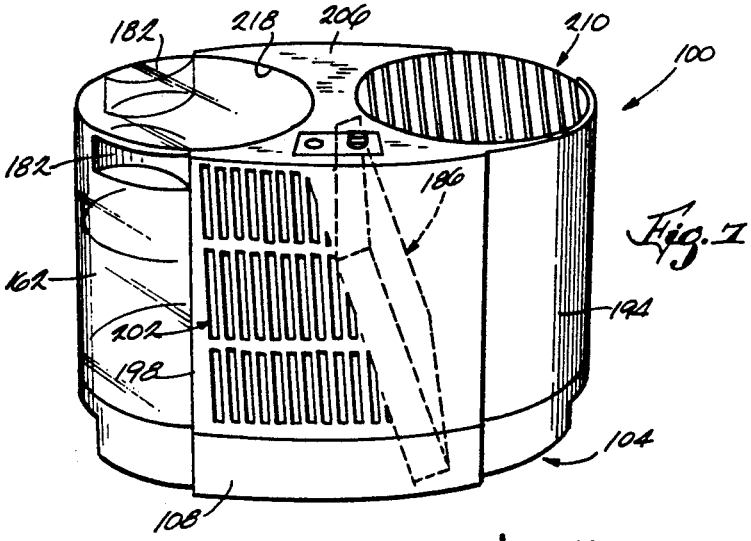
FIG. 7 is a rear perspective view of a humidifier that is a third alternative embodiment of the invention.

The humidifier 100 further comprises a cover 194 which sits on the left end of the base 104 (as shown in FIG. 11). The cover 194 includes a generally vertical rear wall 198 having therein an air inlet grille 202, and the cover 194 also includes a generally horizontal top wall 206 having therein an air outlet grille 210. The cover 194 supports a motor and fan assembly 214 located beneath the air outlet grille 210. As best shown in FIG. 7, the cover 194 is generally elliptical in horizontal cross-section, except that one end of the cover 194 (the left end as shown in FIG. 7, the right end as shown in FIG. 11) defines a semi-cylindrical recess 218 housing approximately the inner half of the water bottle 162. When the cover 194 and the water bottle 162 are mounted on the base 104, the combination of the cover and the bottle has a horizontal cross-section that is substantially identical to the cross-section of the base 104. As a result, the entire humidifier is substantially symmetrical about a vertical plane 222 (represented by line 10—10 in FIG. 8) extending from front to back (extending from top to bottom in FIG. 8). This gives the assembled humidifier a neat, clean appearance.

The fan 214 draws air into the humidifier 100 through the air inlet openings 144 and 148 and through the air inlet grille 202. Air flows to the air inlet openings 144 and 148 primarily through the openings 158, but some additional air simply flows between the supporting surface 116 and the base bottom wall 112 at other locations around the periphery of the base 104. Air entering the humidifier through the openings 144 and 148 and through the grille 202 flows through the wicking element 186 (in the direction of its minor dimension) and then out through the air outlet grille 210. Water in the water trough 128 saturates the wicking element 186, and the wicking element transfers this water to the air passing through the wicking element. As explained above, the tilted wicking element increases water transfer to the air flowing through the wicking element. Location of the air inlet openings 144 and 148 below the tilted wicking element 186 increases air flow through the wicking element. The combination of the tilted wicking element 186 and the inlet openings 144 and 148 in the bottom of the base 104 provides better humidification than do other humidifiers having similarly-sized wicking elements and similarly-sized fans.

Various features of the invention are set forth in the following claims.

We claim:

1. A portable humidifier adapted to rest on a supporting surface, said humidifier comprising a base defining a water reservoir and including a bottom wall having therein an air inlet opening spaced horizontally from said reservoir, means for supporting said bottom wall above the supporting surface, a wicking element having a lower portion in fluid communication with said water reservoir, extending transversely relative to vertical and relative to horizontal, and having an upper portion extending above said inlet opening, and blower means for forcing air flow through said inlet opening and through said wicking element, said blower means being supported over said lower portion of said wicking element.

2. A humidifier as set forth in claim 1 wherein said base is generally elliptical in horizontal cross-section, and wherein said humidifier further comprises a water bottle for supplying water to said reservoir, said water bottle being seated on said base adjacent one end thereof, and said water bottle being generally cylindrical and having a generally vertical longitudinal axis, and a cover which is seated on said base adjacent said water bottle and which extends over the remainder of said base, said cover being generally elliptical in horizontal cross-section except for a substantially semi-cylindrical recess housing approximately ½ of said water bottle, such that the combination of said cover and said water bottle has a horizontal cross-section substantially identical to the horizontal cross-section of said base.

3. A humidifier as set forth in claim 1 wherein said wicking element is generally planar.

4. A humidifier as set forth in claim 1 wherein said reservoir is T-shaped and includes perpendicular first and second legs, wherein said inlet opening is located on one side of said first leg adjacent said second leg, and wherein said base has therein a second air inlet opening located on the opposite side of said first leg adjacent said second leg.

5. A humidifier as set forth in claim 4 wherein said first leg has a first end communicating with said second leg and a second end opposite said first end, and wherein said humidifier further comprises means for supplying water to said second end of said first leg.

6. A humidifier as set forth in claim 5 wherein said water supplying means includes a water bottle seated on said base above said second end of said first leg.

7. A humidifier as set forth in claim 6 wherein said lower portion of said wicking element is seated in said second leg of said reservoir, and wherein said wicking element has an upper end tilted toward said water bottle.

8. A humidifier comprising a base defining a water reservoir and including a bottom wall having therein an air inlet opening spaced horizontally from said reservoir, means for supplying water to said reservoir, said water supplying means including a water bottle seated on said base, means for supporting said bottom wall above a supporting surface, a wicking element having a portion in fluid communication with said water reservoir, said wicking element being located on the opposite side of said inlet opening from said water bottle, and means for forcing air flow through said inlet opening and through said wicking element.

9. A humidifier as set forth in claim 8 wherein said portion of said wicking element is located in said water reservoir.

10. A humidifier as set forth in claim 8 wherein said humidifier is intersected by a horizontal plane, and wherein said wicking element has a minor dimension extending transversely to said horizontal plane.

11. A humidifier as set forth in claim 10 wherein said wicking element has a first major dimension which is greater than said minor dimension and which extends generally perpendicularly to said minor dimension, and a second major dimension which is greater than said minor dimension and which extends generally perpendicularly to said first major dimension and to said minor dimension.

12. A humidifier as set forth in claim 11 wherein said forcing means causes air flow through said wicking element in the direction of said minor dimension.

13. A portable humidifier adapted to rest on a supporting surface, said humidifier comprising a base defining a water reservoir and including a bottom wall having therein an air inlet opening spaced horizontally from said reservoir, said base being generally elliptical in horizontal cross-section, means for supporting said bottom wall above the supporting surface, a wicking element having a lower portion in fluid communication with said water reservoir, extending transversely relative to vertical and extending above said inlet opening, means for forcing air flow through said inlet opening and through said wicking element, a water bottle for supplying water to said reservoir, said water bottle being seated on said base adjacent one end thereof, and said water bottle being generally cylindrical and having a generally vertical longitudinal axis, and a cover which is seated on said base adjacent said water bottle and which extends over the remainder of said base, said cover being generally elliptical in horizontal cross-section except for a substantially semi-cylindrical recess housing approximately ½ of said water bottle, such that the combination of said cover and said water bottle has a horizontal cross-section substantially identical to the horizontal cross-section of said base.

14. A portable humidifier adapted to rest on a supporting surface, said humidifier comprising a base defining a water reservoir which is T-shaped and which- includes perpendicular first and second legs, said first leg having a first end communicating with said second leg and a second end opposite said first end, and said base including a bottom wall having therein first and second air inlet openings spaced horizontally from said reservoir, said first inlet opening being located on one side of said first leg adjacent said second leg, and said second air inlet opening being located on the opposite side of said first leg adjacent said second leg, and said base being generally elliptical in horizontal cross-section, means for supporting said bottom wall above the supporting surface, a water bottle for supplying water to said second end of said first leg of said reservoir, said water bottle being seated on said base adjacent one end thereof, and said water bottle being generally cylindrical and having a generally vertical longitudinal axis, a wicking element which has a lower portion seated in said second leg of said reservoir, and which has an upper end tilted toward said water bottle such that said wicking element extends above said inlet openings, a cover which is seated on said base adjacent said water bottle and which extends over the remainder of said base, said cover being generally elliptical in horizontal cross-section except for a substantially semi-cylindrical recess housing approximately ½ of said water bottle, such that the combination of said cover and said water bottle has a horizontal cross-section substantially identical to the horizontal cross-section of said base, and said cover having therein an air outlet, and means for forcing air flow through said inlet openings, through said wicking element, and through said outlet.

15. A portable humidifier adapted to rest on a supporting surface, said humidifier comprising a base defining a water reservoir and including a bottom wall having therein an air inlet opening spaced horizontally from said reservoir, said reservoir being T-shaped and including perpendicular first and second legs, said inlet opening being located on one side of said first leg adjacent said second leg, and said base having therein a second air inlet opening located on the opposite side of said first leg adjacent said second leg, means for supporting said bottom wall above the supporting surface, a wicking element having a lower portion in fluid communication with said water reservoir, extending transversely relative to vertical and extending above said inlet opening, and means for forcing air flow through said inlet opening and through said wicking element.

16. A humidifier as set forth in claim 15 wherein said first leg has a first end communicating with said second leg and a second end opposite said first end, and wherein said humidifier further comprises means for supplying water to said second end of said first leg.

17. A humidifier as set forth in claim 16 wherein said water supplying means includes a water bottle seated on said base above said second end of said first leg.

18. A humidifier as set forth in claim 17 wherein said lower portion of said wicking element is seated in said second leg of said reservoir, and wherein said wicking element has an upper end tilted toward said water bottle.

* * * * *